US006922934B1

(12) United States Patent
Huan

(10) Patent No.: US 6,922,934 B1
(45) Date of Patent: Aug. 2, 2005

(54) MOUNTING BRACKET FOR SCOPE OF A GUN

(75) Inventor: Che Kum Huan, Taichung (TW)

(73) Assignee: Taiwan Ministry of Defence Plant 402, Bureau of Armaments Acquisition, Taichung (TW)

( * ) Notice: Subject to any disclaimer, the term of this patent is extended or adjusted under 35 U.S.C. 154(b) by 30 days.

(21) Appl. No.: 10/851,118

(22) Filed: May 24, 2004

(51) Int. Cl.[7] ..... F41C 3/14
(52) U.S. Cl. ..... 42/127
(58) Field of Search ..... 42/127, 114, 146, 42/148; 89/41.17

(56) References Cited

U.S. PATENT DOCUMENTS 4,934,085 A * 6/1990 Lough ..... 42/127
5,111,587 A * 5/1992 Plank ..... 42/127
5,155,915 A * 10/1992 Repa ..... 42/127
5,430,967 A * 7/1995 Woodman et al. ..... 42/114
5,680,725 A * 10/1997 Bell ..... 42/127
6,438,888 B1 * 8/2002 Lin et al. ..... 42/114
6,637,144 B2 * 10/2003 Nebarez et al. ..... 42/120

FOREIGN PATENT DOCUMENTS

DE 4133932 A1 * 4/1993 ..... F41G/1/387

* cited by examiner

*Primary Examiner*—Michael J. Carone
*Assistant Examiner*—M. Thomson
(74) *Attorney, Agent, or Firm*—Leong C. Lei

(57) ABSTRACT

A mounting bracket for a scope of a gun is disclosed. The mounting bracket is used to mount night scopes or telescopic scopes onto the barrel of a gun rapidly. The bracket comprises a seat body having a securing jaw, an actuating jaw and a triggering block, and the actuating jaw is pivotally mounted at the seat body and, together with the securing jaw, correspondingly grips the barrel of the gun. Further, the triggering block is pivotally mounted at the seat body, and the triggering block correspondingly urges or releases the actuating jaw. The user can rapidly disassemble the mounting bracket and the barrel of the gun. The direction of action of the triggering block is perpendicularly intersected with the vibration direction of the barrel and therefore the mounting bracket will not be dislocated in the course of shooting.

5 Claims, 4 Drawing Sheets

MOUNTING BRACKET FOR SCOPE OF A GUN

BACKGROUND OF THE INVENTION (a) Technical Field of the Invention

The present invention relates to a mounting bracket of a gun, and in particular, to a mounting bracket for a telescopic scope or night scope which can be rapidly loaded or unloaded onto the barrel of the gun without dislocation.

(b) Description of the Prior Art

For guns capable of long-stance shooting, such as rifles or machine guns, in order to enhance shooting accuracy or use of the guns in an unfavorable environment, a scope, telescopic sight or night scope are mounted. Therefore, the specification for the mounting of the scope tends to be standardized so that the loading and unloading can be rapidly carried out. Thus, a mounting bracket is generally used to mount the scope onto the barrel of a gun. FIG. 1 is a conventional mounting bracket 20 which is mounted at the two lateral sides of the barrel 10. A sliding rail 15 is formed on the side edge and there are positioning slots 16 on the sliding rail 15 for the positioning of the mounting bracket 20. The mounting bracket 20 has a seat body 21, and the lower section of the seat body 21 has a securing jaw 23 corresponding to the sliding rail 15. The securing jaw 23 has a notch 230, and there is a through hole 24 on the securing jaw 23, which corresponds to the positioning slot 16.

On the other side of the sliding rail 15 there is an actuating jaw 25 having a slot 250, and the actuating jaw 25 has a through hole 26 corresponding to the through hole 24 of the securing jaw 23. By using locking rod 27 passing through the through hole 24 of the securing jaw 23 and the positioning slot 16 and the through hole 26, a screw nut 28 is then fastened thereto. Thus, the seat body 21 is mounted to the sliding rail 15 using the securing jaw 23 and the notches 230, 250 of the actuating jaw 25. Through the action of the locking rod 27 with respect to the positioning slot 16, a positioning effect is obtained. In order to dismantle the mounting bracket 20, the locking element 28 is released until the actuating jaw 25 is completely dislocated from the sliding rail 15. Thus, the mounting bracket 20 is unloaded.

There are drawbacks in view of the conventional mounting bracket for scope of the gun:

[1] Laborious in assembly and disassembly: The actuating jaw 25 has to be fully dislocated from the sliding rail 15 in order to unload the mounting bracket, the locking element 28 has to be loosened for a longer period of time and it is laborious and time consuming. It is not practical in view of rapid changes required in battlefield conditions.

[2] Dislocation: The rotating direction of the locking element 28 is similar to the direction of the vibration of the barrel 10 before and after shooting. The locking element 28 will be easily dislocated after a few rounds of firing. Hence, the firing accuracy will be affected. Thus, the mounting bracket has to be re-tightened. However, if it is tightened too strongly, the locking element 28 can be easily damaged and moreover, it will take a longer time to tighten.

In view of the above, it is an object of the present invention to provide a mounting bracket for scope of a gun which mitigates the above drawbacks.

SUMMARY OF THE INVENTION

Accordingly, it is an object of the present invention to provide a mounting bracket for the scope of a gun which mitigates the drawbacks of the conventional mounting bracket.

An aspect of the present invention is to provide a mounting bracket comprising a seat body, an actuating jaw and a triggering block, wherein the top face of the seat body is a securing seat for mounting scopes, and one side of the seat body is downwardly extended to a securing jaw and the inner face of the securing jaw is a notch corresponding to the sliding rail, and the seat body at the opposite side of the securing jaw is a circular pivotal path which can be pivotally mounted with an actuating jaw, and the top edge of the seat body is protrudingly extended to form an inverted L-shaped suspension lug and the triggering block is pivotally positioned between two suspension lugs; the actuating jaw corresponding to the inner face at one side of the securing jaw is provided with a notch and the top edge of the actuating jaw is a pivotal rail which can pass through the pivotal path, and the external side face of the actuating jaw is an urging face for stopping the triggering block; and the top edge of the triggering block having an inverted L-shaped body is an urging block corresponding to the actuating jaw, the urging block of the triggering block is pivotally mounted at the suspension lug of the seat body and the distance between the end face of the urging block to the pivot point center is longer than the distance from the top face to the pivot point center and the triggering block can tightly urge or release the actuating jaw.

Yet another object of the present invention is to provide a mounting bracket for the scope of a gun, wherein the mounting bracket and the barrel can be rapidly disassembled and the direction of action of the triggering block is perpendicularly intersected with the vibration direction of the barrel and therefore the mounting bracket will not be dislocated in the course of shooting.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
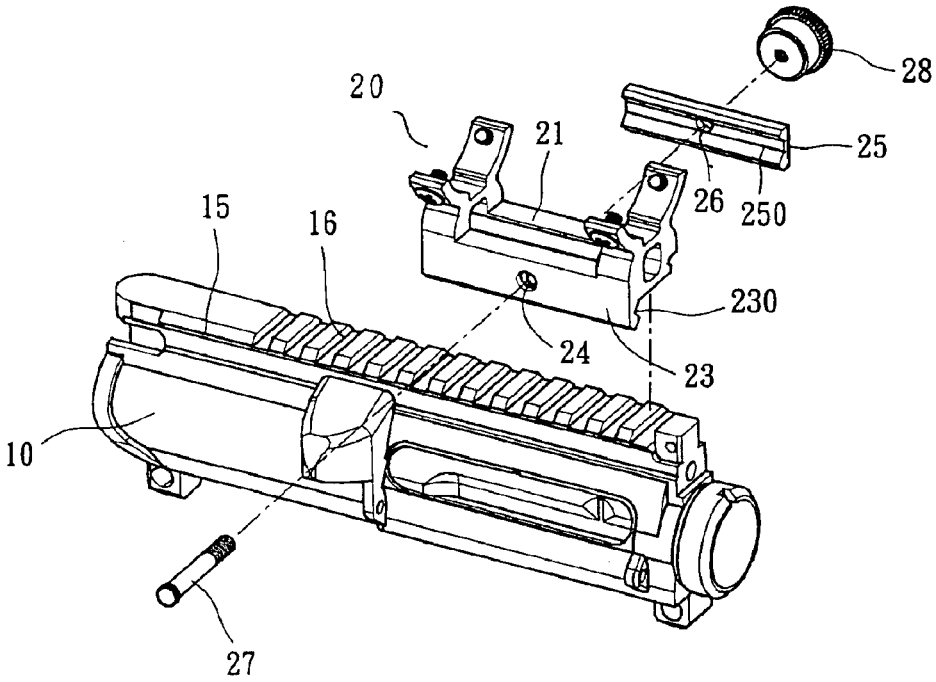
PRIOR ART FIG. 1
FIG. 1 is an exploded perspective view of a conventional mounting bracket for the scope of a gun, showing the relationship of the individual components of the mounting bracket.
Figure 2:
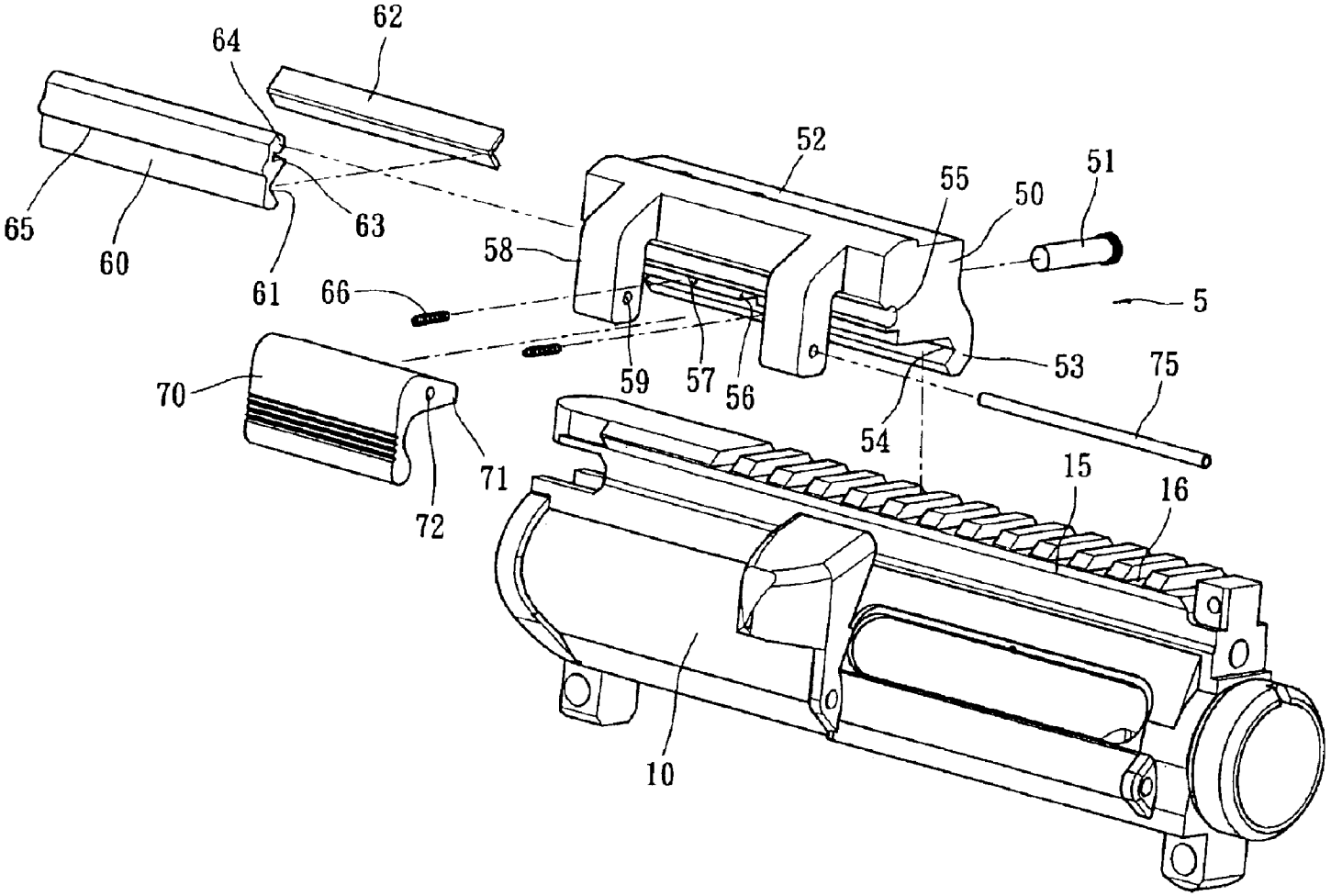
FIG. 2 is an exploded perspective view of the mounting bracket for the scope of a gun of the present invention.

FIG. 2 shows the mounting bracket for the scope of a gun in accordance with the present invention. As shown in the figure, the mounting bracket 5 comprises a seat body 50, an actuating jaw 60 and a triggering block 70 for mounting a scope, which is then positioned onto a sliding rail 15 of the barrel 10 of the gun.

Figure 3:
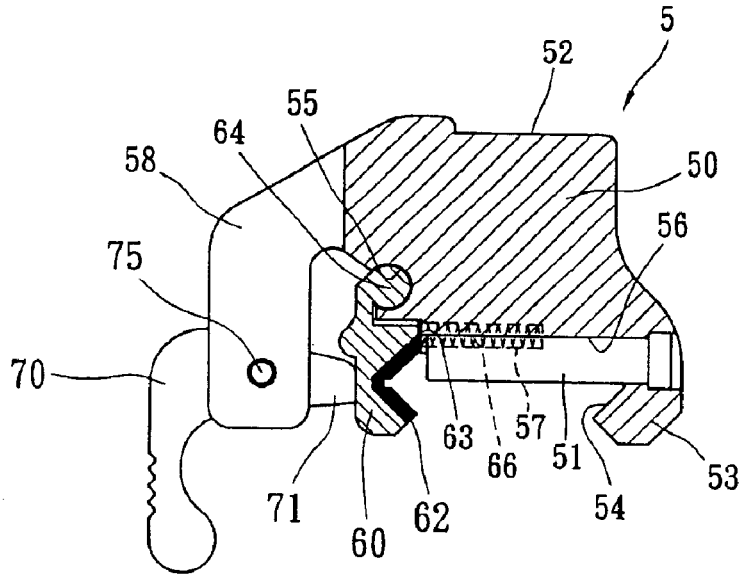
FIG. 3 is a sectional view of the mounting bracket for the scope of the present invention.

Referring to FIGS. 2 and 3, the top face of the seat body 50 is a securing seat 52 for mounting various types of scopes such as telescopic scopes or night scopes, etc. One side of the seat body 50 is downwardly extended to form a securing jaw 53 and the inner face of the securing jaw 53 is provided with a corresponding notch 54. At the opposite side of the securing jaw 53 of the seat body 50 a through circular pivotal path 55 is formed which is used to pivotally mount an actuating jaw 60. The middle section of the securing jaw 53 of the seat body 50 is provided with a through hole 56 corresponding to the positioning slot 16 of the sliding rail 15. The through hole 56 can be used to insert a positioning rod 51 and at the two sides of the through hole 56 of the seat body 50 are respectively formed with a cavity 57 corresponding to the actuating jaw 60. The top edge of the seat body 50 is extended to form an inverted L-shaped suspension lug 58, and a corresponding pivotal hole 59 is formed on the two suspension lugs 58 for pivotally mounting the trigger block 70 at the external of the actuating jaw 60.

The actuating jaw 60 corresponding to the inner face of the securing jaw 53 is formed with a notch 61. The notch 61 has a corresponding pad 62 and the top edge of the actuating jaw 60 is a pivotal rail 64. The pivotal rail 64 enables he actuating jaw 60 to be mounted at the pivotal path 55. The notch 61 is formed with a pushing face 63 corresponding to the cavity 57. The cavity 57 has an elastic element 66 urging the pushing face 63. The external face of the actuating jaw 60 is provided with a triggering block 70 stopping the urging face 65.

The triggering block 70 is an inverted L-shaped body and the top edge of the triggering block 70 is extended to an urging block 71 corresponding to the actuating jaw 60. The middle section of the urging block 71 has a pivotal hole 72 and a pivotal rod 75 is used to pivotally mount the triggering block 70 in between two suspension lugs of the seat body 50, and the distance of the end of the triggering block 70 to the pivotal point center is longer than the distance from the top face to the center of pivotal hole 72, and the triggering block 70 can urge or release the actuating jaw 60. Thus, a mounting bracket for a scope which can be rapidly assembled is obtained.

Figure 4:
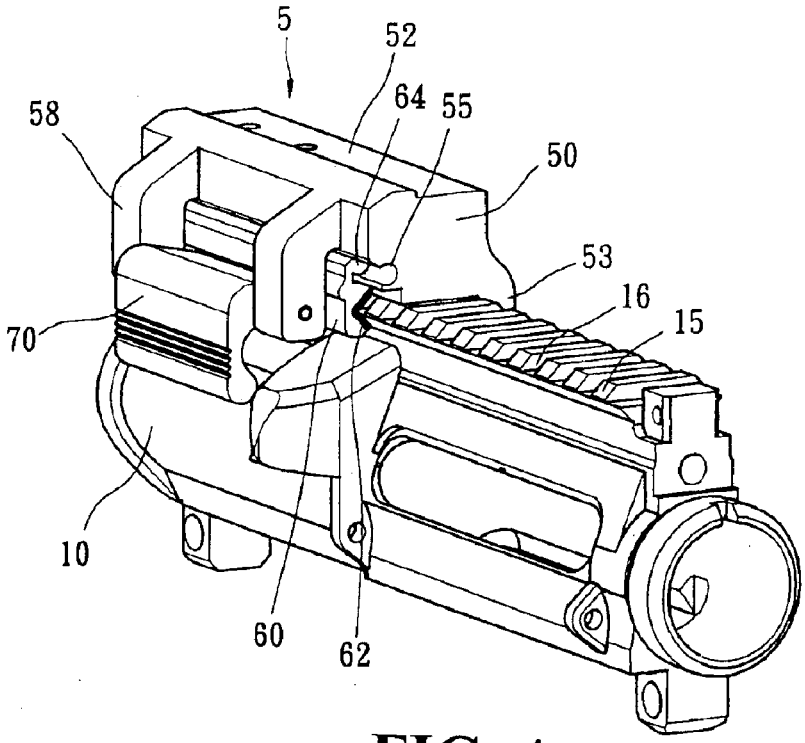
FIG. 4 is a perspective view of the mounting bracket for the scope of the present invention in accordance with the present invention.
Figure 5:
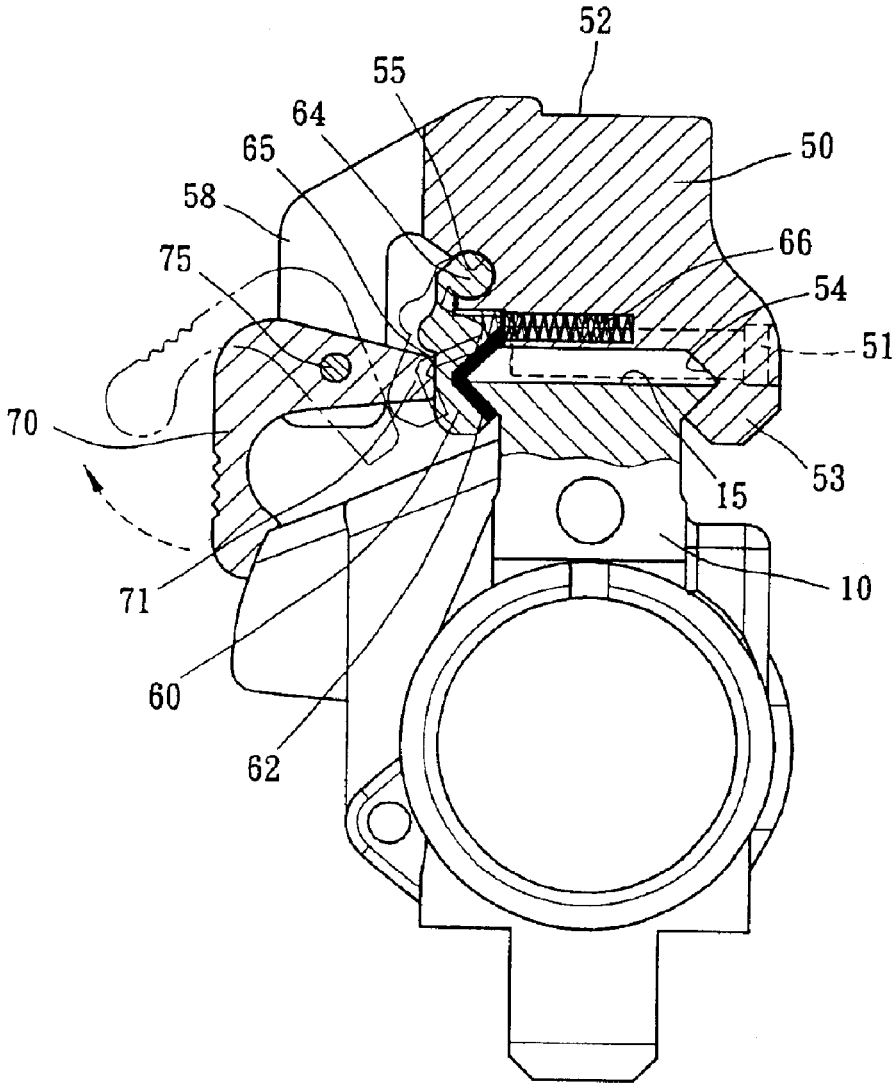
FIG. 5 is a schematic view showing the mounting bracket being mounted onto the barrel of the gun in accordance with the present invention.

In operation, as shown in FIGS. 4 and 5, the telescopic scope or night scope is mounted to the mounting bracket 52 of the seat body 50, and next, the securing jaw 53 is mounted to the sliding rail 15 of the barrel 10 by means of the notch 54, and the positioning rod 51 of the seat body 50 is appropriately engaged at the positioning slot 16 on the sliding rail 15.

The actuating jaw 60 is mounted on the other side of the sliding rail 15 by means of the pad 62. Next, the triggering block 70 is depressed, and the end face of the urging block 71 can urge the urging face 65 of the actuating jaw 60 and the pad 62 of the actuating jaw 60 is slightly compressed so that the mounting bracket 5 can make use of the securing jaw 53 and the actuating jaw 60 to be fully secured to the sliding rail 15.

When the user wants to unload the mounting bracket 5, the triggering block 70 is released and the urging block 71 will not urge the urging face 65 of the actuating jaw 60, and the actuating jaw 60 can be extended as a result of the elastic member 66 of the seat body 50. Thus, the mounting bracket 5 loses the force to grip onto the sliding rail 15 and the mounting bracket can be rapidly unloaded.

In view of the above, the mounting bracket 5 can be effectively mounted onto the barrel 10 and further advantages are as follows:

[1] Rapid assembly and disassembly: As assembly and disassembly of the mounting bracket 5 is achieved by means of the triggering block 70, the user can rapidly load and unload the mounting bracket 5.

[2] No dislocation: The pad 62 within the actuating jaw 60 enhances gripping force and the direction of action of the triggering block 70 is perpendicularly intersected with the direction of vibrations before and after firing the weapon, and thus in the course of shooting, the triggering block 70 will not be dislocated as a result of vibration. In view of the above, the user will have a high degree of shooting accuracy.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. Amounting bracket for a scope of a gun for gripping onto the sliding rail of the barrel of the gun, having a seat body, an actuating jaw and a triggering block, characterized in that the top face of the seat body is a securing seat for mounting scopes, and one side of the seat body is downwardly extended to a securing jaw and the inner face of the securing jaw is a notch corresponding to the sliding rail, and the seat body at the opposite side of the securing jaw is a circular pivotal path which can be pivotally mounted with an actuating jaw, and the top edge of the seat body is protrudingly extended to form an inverted L-shaped suspension lug and the triggering block is pivotally positioned between two suspension lugs;

the actuating jaw corresponding to the inner face at one side of the securing jaw is provided with a notch and the top edge of the actuating jaw is a pivotal rail which can pass through the pivotal path, and the external side face of the actuating jaw is an urging face for stopping the triggering block; and the top edge of the triggering block having an inverted L-shaped body is an urging block corresponding to the actuating jaw, the urging block of the triggering block is pivotally mounted at the suspension lug of the seat body and the distance between the end face of the urging block to the pivot point center is longer than the distance from the top face to the pivot point center and the triggering block can tightly urge or release the actuating jaw.

2. The mounting bracket for a scope according to claim 1, wherein the sliding rail of the barrel is a series of positioning slots and the middle section of the securing jaw of the seat body is a through hole corresponding to the positioning slot of the sliding rail and the through hole can hold a positioning rod so that the mounting bracket can engage at the sliding rail.

3. The mounting bracket for a scope according to claim 1, wherein the securing jaw of the seat body is a plurality of cavities corresponding to the actuating jaw and the top portion of the notch is a push top face corresponding to the cavities, and the cavities are mounted with elastic which can urge the top face and allows the actuating jaw to be released when the triggering block is opened.

4. The mounting bracket for scope according to claim 1, wherein the suspension lug of the seat body is formed with corresponding holes and the middle section of the urging block is a pivotal hole so that the pivotal rod can pivotally mount the trigger block between two suspension lugs.

5. The mounting bracket for scope according to claim 1, wherein the interior of the notch of the actuating jaw is provided with a corresponding notch-shaped pad to enhance gripping force.

* * * * *